US011657829B2

(12) United States Patent
Popovic et al.

(10) Patent No.: US 11,657,829 B2
(45) Date of Patent: May 23, 2023

(54) ADAPTIVE NOISE CANCELLING FOR CONFERENCING COMMUNICATION SYSTEMS

(71) Applicant: Mitel Networks Corporation, Ottawa (CA)

(72) Inventors: Mirjana Popovic, Ottawa (CA); Dieter Schulz, Dunrobin (CA); Roger Bastin, Ottawa (CA); Andrew Wu, Kanata (CA); Logendra Naidoo, Ottawa (CA)

(73) Assignee: Mitel Networks Corporation, Ottawa (CA)

( * ) Notice: Subject to any disclaimer, the term of this patent is extended or adjusted under 35 U.S.C. 154(b) by 80 days.

(21) Appl. No.: 17/243,404

(22) Filed: Apr. 28, 2021

(65) Prior Publication Data

US 2022/0351742 A1 Nov. 3, 2022

(51) Int. Cl.

| | |
|---|---|
| ***G10L 21/0216*** | (2013.01) |
| ***G10K 11/178*** | (2006.01) |
| ***H04R 1/32*** | (2006.01) |
| ***H04R 1/40*** | (2006.01) |

(52) U.S. Cl.

CPC .... *G10L 21/0216* (2013.01); *G10K 11/17823* (2018.01); *H04R 1/326* (2013.01); *H04R 1/406* (2013.01); *G10K 2200/10* (2013.01); *G10K 2210/1082* (2013.01); *G10K 2210/12* (2013.01); *G10L 2021/02166* (2013.01); *H04R 2201/40* (2013.01); *H04R 2410/01* (2013.01); *H04R 2430/20* (2013.01); *H04R 2499/11* (2013.01)

(58) Field of Classification Search

CPC ..... G10L 21/0216; G10L 2021/02166; G10K 11/17823; G10K 2200/10; G10K 2210/1082; G10K 2210/12; H04R 1/326; H04R 1/406; H04R 2201/40; H04R 2410/01; H04R 2430/20; H04R 2499/11

USPC ..... 381/71.1

See application file for complete search history.

(56) References Cited

U.S. PATENT DOCUMENTS

| | | | |
|---|---|---|---|
| 7,130,797 | B2 | 10/2006 | Beaucoup et al. |
| 8,565,443 | B2 | 10/2013 | Wurm |
| 8,611,551 | B1 | 12/2013 | Massie et al. |
| 9,082,391 | B2 | 7/2015 | Yermeche et al. |
| 9,099,077 | B2 | 8/2015 | Nicholson et al. |
| 9,143,858 | B2 | 9/2015 | Alves et al. |
| 9,313,453 | B2 | 4/2016 | El-Solh et al. |

(Continued)

*Primary Examiner* — Paul Kim
*Assistant Examiner* — Douglas J Suthers

(57) ABSTRACT

A communication system with a noise cancellation (NC) assembly providing adaptive or dynamic noise cancellation. The NC assembly includes a localizer module determining, during a communication session (active speaking or during idle times), a location of the active talker. The NC assembly includes a beam generator forming a beam in the determined direction of the active talker to enhance the active talker speech. Once the NC assembly has determined the position of the active talker, the NC assembly assigns a microphone of the microphone array or generated beam in that active direction to be the "active signal" source. The NC assembly assigns a second microphone or beam to be the noise source for NC purposes, and this source may be selected to be in acoustic shadow of the first microphone used as the active signal source or may be the farthest away in its position from the active talker's position.

17 Claims, 7 Drawing Sheets

(56) References Cited

U.S. PATENT DOCUMENTS

| | | | | |
|---|---|---|---|---|
| 9,402,132 | B2 | 7/2016 | Park et al. | |
| 9,966,059 | B1 * | 5/2018 | Ayrapetian | H04R 1/08 |
| 10,224,018 | B2 | 3/2019 | Woelfl et al. | |
| 10,347,233 | B2 | 7/2019 | Park et al. | |
| 10,685,639 | B2 | 6/2020 | Tzanetos | |
| 2005/0060142 | A1 | 3/2005 | Visser et al. | |
| 2005/0149320 | A1 * | 7/2005 | Kajala | H04R 3/005<br>704/206 |
| 2005/0195989 | A1 | 9/2005 | Sato et al. | |
| 2017/0084288 | A1 | 3/2017 | Chatlani | |
| 2018/0033447 | A1 | 2/2018 | Ramprashad et al. | |
| 2019/0222804 | A1 | 7/2019 | Rudberg et al. | |

* cited by examiner

ADAPTIVE NOISE CANCELLING FOR CONFERENCING COMMUNICATION SYSTEMS

FIELD OF THE INVENTION

The present disclosure generally relates to electronic communication methods and systems including those that include multiple microphones to facilitate two or more talkers (or active talkers or call participants) or one or more talkers without a static position relative to the microphones, such as conference phone systems. More particularly, examples of the disclosure relate to electronic communication methods and systems that provide adaptive noise cancelling during, or throughout the length of, a communication session (e.g., a conference call or, more simply, a call).

BACKGROUND OF THE DISCLOSURE

There are many acoustical applications where effective noise cancellation is desirable or even nearly essential. Examples of such applications or environments include the following: physical ear protection in machinery and industrial applications; noise cancellation for communication headsets such as in airplane operations, noise cancellation in recreational audio systems such as those used for soundtracks and music playback, and noise cancellation in telecom systems such as conference phone system (or simply "conference systems").

Providing effective noise cancellation is especially challenging in environments in which the audio source (such as a talker in a conference call) or a noise source is not located in a static position but is instead moving or changing relative to a communication system's microphones. In the conferencing environment, the talker may move about a conference room or space, the active talker or audio source may change over time, and positions of noise sources may vary during the conference session. Often, the noise cancelling solution has been implemented as if these sources of audio or noise are static, which has led to less than optimal results.

As a result, noise cancellation issues remain prevalent in the acoustical products industry irrespective of attempts to cancel background noise without compromising audio quality. Continuing with the conferencing example, current conference telephony-based methods of noise cancellation often prove inadequate. This is in part because noise cancellation in these systems has tended to focus on simple subtraction of noise from total signal on the front end relying on a static audio source or a static noise source.

Many existing methods attempt to cancel noise in a predefined space through the addition of sensors that are placed at positions within that area and then by producing an audio signal of the same magnitude and at 180 degrees out of phase with the noise waveform to cancel out the noise. Another challenge to providing effective noise cancellation is that adaptive processing involved in such noise cancellation (NC) methods is highly computational and complex. Hence, most NC methods lean towards designs to cancel noise synchronously (i.e., cancel repetitive background noise), but this results in intermittent noise that may occur at regular intervals not being cancelled and possibly disrupting the audio signal or its quality.

Any discussion of problems provided in this section has been included in this disclosure solely for the purposes of providing a background for the present invention and should not be taken as an admission that any or all of the discussion was known at the time the invention was made.

BRIEF DESCRIPTION OF THE DRAWING FIGURES

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements and wherein:

Figure 1:
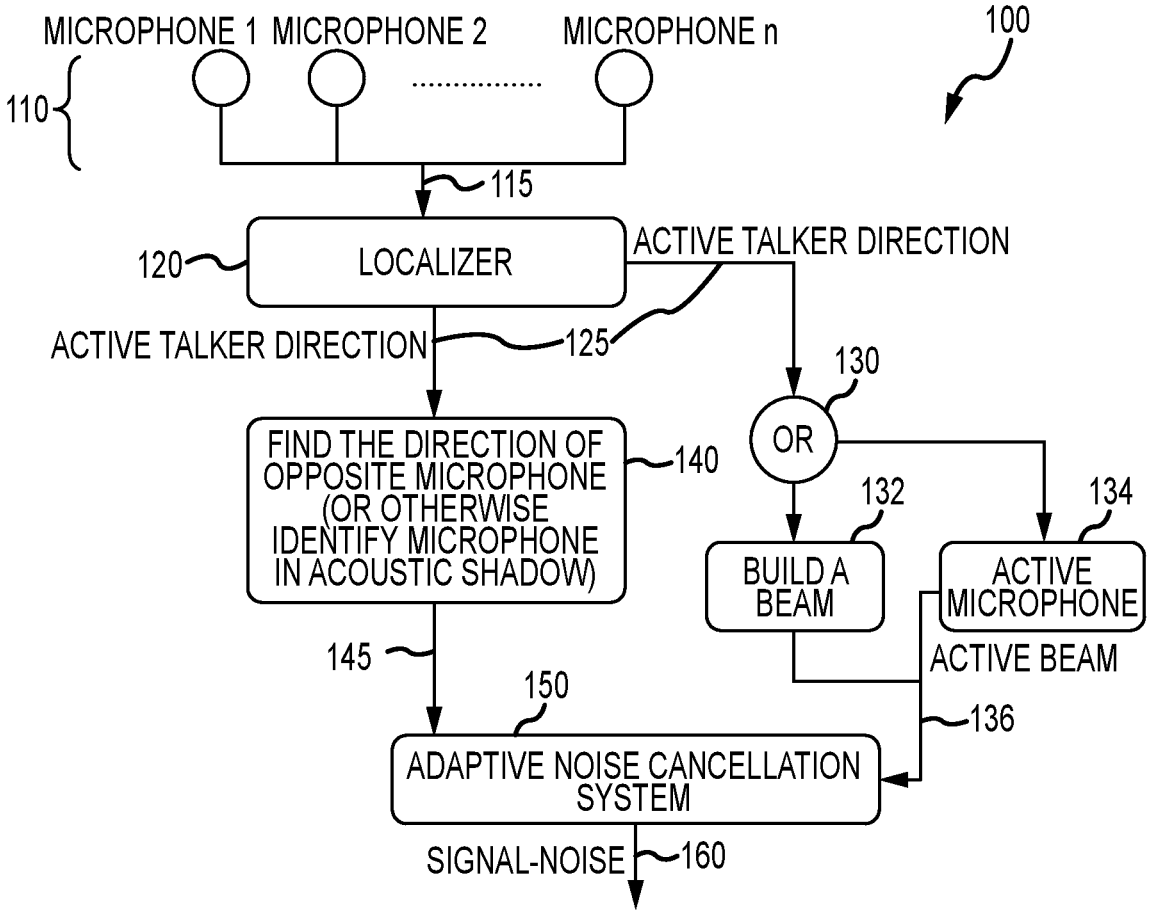
FIG. 1 illustrates a functional schematic of the noise cancellation (NC) process carried out by NC assemblies or systems of the electronic communication systems of the present description.

It will be appreciated that elements in the figures are illustrated for simplicity and clarity and have not necessarily been drawn to scale. For example, the dimensions of some of the elements in the figures may be exaggerated relative to other elements to help to improve understanding of illustrated embodiments of the present invention.

DETAILED DESCRIPTION OF EXEMPLARY EMBODIMENTS

The description of exemplary embodiments of the present invention provided below is merely exemplary and is intended for purposes of illustration only; the following description is not intended to limit the scope of the invention disclosed herein. Moreover, recitation of multiple embodiments having stated features is not intended to exclude other embodiments having additional features or other embodiments incorporating different combinations of the stated features.

As set forth in more detail below, exemplary embodiments of the disclosure relate to electronic communication systems, and corresponding methods performed by such systems, that can, for example, provide adaptive noise cancelling or cancellation (NC). The NC techniques described herein can be used in nearly any communication system or environment in which the position or location of sources of audio (e.g., an active talker on a call or in a meeting) and noise may change over time (e.g., during the communication session provided by the electronic communication system).

In creating the communication systems that implement the new NC methods, the inventors recognized that prior conference telephony-based methods of noise cancellation could be significantly improved if they were designed and produced to provide the following design advantages: (1) more than two microphones (e.g., in a distributed-position array); (2) determination and use of which microphone in the array is situated closest to the voice signal (e.g., position (which may change over time) of the active talker or audio source versus and which microphone in the array is to be used for the noise source (which may or may not move over time or be ongoing or intermittent); and (3) use of a beam to arrange multiple microphones in the array to create a directional response (e.g., beam pattern) to the voice signal as opposed to the noise signal. Stated differently, one useful advantage of the new NC method is that it dynamically selects the most optimal speech microphone (beam)/noise microphone (beam) pair for every talker position, whereas other systems perform the NC based on the static assumption of the talker position which is not the optimal solution when the talker is not at the expected location. The beam is used as a speech source (with the speech being enhanced with beam, high SNR, for example) and microphone as the noise source, and, in the NC method, speech is not enhanced, typically, at the microphone (low SNR) and the noise source is desirably in the acoustic shadow and picking up very little speech of the active talker.

In a typical prior system, noise cancellation relied on a fixed active talker position. Hence, of the two microphones used for noise cancellation, one microphone is always associated with the noise source (i.e., same microphone throughout the communication session) while the other microphone is associated with the active signal (i.e., same microphone throughout the communication session is used to receive audio from an active talker or other audio source). The inventors determined that for good noise cancellation quality, it is important that the noise source microphone is mostly isolating the noise in the space in which the array of microphones is located while it picks up or senses as little of the speech or audio source signal as possible. The existing NC techniques with fixed source positions being assumed work well for NC headsets and other applications where the talker position is more controlled, but these existing NC techniques do not work well in environments, such as many conference room situations, where the users can vary over time or where the positions of the active talker may vary during a communication session or meeting.

To provide improved noise cancellation, the new communication system design includes a noise cancellation (NC) assembly or unit that includes a localizer module to determine, on an ongoing basis during a communication session, a location of the active talker (or other input audio source), e.g., by determining a current direction to the talker relative to the array of microphones. The NC assembly may further include a beam generator that creates a beam in the determined direction of the active talker to enhance the active talker speech. Once the NC assembly has determined the accurate position of the incoming speech signal from the active talker, the NC assembly can assign a microphone of the microphone array of the communication system in that active direction to be the "active signal" source (e.g., the microphone in the array determined to be closest in its position to the active talker position). Further, the NC assembly can assign a second microphone to be the noise source for NC purposes, and this microphone may be selected to be in the acoustic shadow of the active talker, which may be in the opposite direction as the first microphone used as the active signal source or may be the farthest away in its position from the active talker's position. Where the noise microphone is in the system will depend on the acoustic design of the system or unit. If the unit has the array of microphones in a circle, then the opposite microphone (or farthest away from the active microphone) will be chosen as the noise microphone. In other designs, this may not be the case with an important selection criteria being that the noise microphone is acoustically positioned to pick up the least amount of the voice/speech for a certain talker position (or is in a position most shielded from voice from a talker position), and this is the intended meaning of "acoustic shadow."

The localizer module may be implemented in a variety of ways to provide the function of determining a direction of the active talker during a communication session, and some NC assembly designs make use of the localizer algorithms for reverberant environments taught in U.S. Pat. No. 7,130,797, which is incorporated herein by reference and implemented in a variety of presently manufactured and distributed conference phone systems, while other designs may use the localization techniques used in non-reverberant environments also taught in U.S. Pat. No. 7,130,797 or other localization approaches in use or yet to be developed.

In some embodiments or operating modes, the NC assembly uses the created beam rather than a particular microphone as the active signal source, and the microphone in the opposite direction of the beam is used as the noise source. Beamforming techniques, any of which are known in the communications industry such that they do not have to be described in detail herein, can be chosen for use in the NC assembly that use a spatial filtering technique for: (1) enhancing the signals from a desired direction that is relative to an array of fixed position microphones; and (2) suppressing noise and interferences from other directions. This alternate or second NC method (or NC assembly operating mode) may be desirable in some cases as it simplifies the NC system and it also makes it more robust as the noise cancellation is done after the localizer and beamformer are done processing (as well as after other system signal processing that may be provided in exemplary communication systems with the new NC assembly.

In some cases, the NC assembly may include additional microphones in the "array" rather than only those relatively statically located in the system (e.g., the set of microphones provided in the body of the conference telephone). Such microphones may be considered remote and mobile as they are spaced apart from the original set of microphones in the communication system's devices and can be moved over time during the communication session. In one embodiment, the remote microphones are provided in the form of mobile communication devices such as smartphones or the like. As one working example, most participants in conference calls (which may be located in a physical room (e.g., a Cisco WebEx Room, a standard conference room, or the like)) use and are in possession of a mobile phone during the communication session, and each of these devices offers an additional microphone(s) that can be used in the NC assembly to provide greater cancellation properties. Particularly, such remote microphones further refine the noise-locating decisions made by the NC assembly by providing microphones that may be more proximate to sources of a noise and can be assigned to be the noise source for noise cancellation processing, with a microphone being farther away from the active talker or input audio source typically being preferred.

In brief, the communication systems described herein include an adaptive noise cancellation system or assembly that typically uses two sources: (1) a first one that is operated as the noise source (which may be a microphone, a beam, or a combination thereof) and (2) a second one that is designated and operated as the active signal source, which is simultaneously corrupted by noise in the space in which the system is operated and which may be a beam, a microphone, or a combination thereof. The NC assembly includes an NC processing module (along with the localizer and beam generator modules) that uses the noise source to subtract the noise (or noise signal) from the active source (or audio source or active talker source signal). The system is not limited to using two microphones for NC processing. For example, a beam may be used as a speech/active signal source (as the speech is enhanced with beam, high SNR) and a microphone as the noise source (speech is not enhanced at the microphone (low SNR), plus the microphone is pointing away from the talker and picking up very little speech).

In the classical NC system, there is the determination of fixed active talker direction. While this works well for NC headsets and other applications in which the talker position is more controlled, it does not work well for conference phones and other communication systems where the talkers/audio source can change position. Advanced conference phones have an array of microphones (e.g., eight to sixteen omnidirectional microphones arranged in a circle or other spaced-apart pattern), thereby improving the position of the direction of the active talker. By expanding on the classical NC model, a communication system with the newly-designed NC assembly can use the microphone that is optimally opposite (directionally) from the active talker to subtract the noise from the beam, microphone, or combination thereof that is determined to be in the direction of the active talker. The NC processing module processes the microphone-provided audio signals after the beamformer or beam generator module provides its output, and the system has the further advantages that only one adaptive NC assembly is needed and there is minimal effect on the other parts of the communication system (e.g., active talker direction can be provided by a conventional localizer module such that redesigns are limited to control costs).

The NC assembly may be used in a wide variety of communication systems and/or environments. The method implemented to provide noise cancellation can be used and adapted for use in nearly any situation in which noise cancellation is required or desirable, where there is an array of microphones available, and where intelligible speed is one of the operating objectives. For example, conference rooms (e.g., a Cisco Webex Room or the like) are equipped with conference units and remote wired speakers, and these rooms may be equipped with the NC system or assembly of the present description to achieve more intelligible speech. In another useful example, a communication system of an automobile where ambient noise within the automobile's interior space (e.g., windshield/window noise, engine noise, road noise, and so on) can create distracting noise. In the automobile setting, a communication system can be provided with an array of microphones that could be employed to subtract noise effectively once the determination is made which microphone is furthest away or pointing in the opposite direction from the microphone used for transmitting the speech signal (or audio or active talker source) so as to be in the acoustic shadow as discussed above.

With this overview of the new adaptive NC techniques in hand, it may be useful to now turn to a more detailed description of these techniques and exemplary communication systems designed to implement such noise cancellation. The conference room setting is highlighted in these examples, but it will be understood that the NC techniques are well suited for many other communication systems. Environmental office noise, such as keyboard clicks, fans and other ventilation, and environmental background sounds, can affect the voice quality on a conference call significantly. Reducing background noise sufficiently generally improves the conference call experience by enhancing voice quality of the conversation provided with conference phones. Although the work-from-home environment is different from the office environment, there are still noises, such as street and traffic noise, construction noise, family chatter, pet noise, and so on that preferably can be reduced to enhance quality of communications.

A typical NC system relies on a fixed active talker position, which means that out of the two microphones or sources used for noise cancellation one is always considered to be the noise source while the other is the active signal (or speech) source. For good NC quality, the inventors recognized that noise cancellation can be improved if the NC system is configured such that the noise source (e.g., a beam, a microphone, or a combination thereof) is predominantly picking up the noise and as little as possible of the speech signal. The inventors also understood that the fixed noise signal microphone or source approach works well for NC headsets and similar applications where the talker position is fixed or limited, it does not work well for situations In which the active talker or their position changes during the communication session.

Hence, the inventors designed a new NC assembly or system for use with a variety of communication systems, including conference phone-based systems. The new NC assembly includes a localizer module that functions to always know where the active talker direction is, and a beam generator module may be included for creating a beam in that direction to enhance the active talker speech. Once the active talker direction is known, the NC processing module of the NC assembly functions to choose the microphone or beam from those available in the communication system that is in that active direction to be the active signal source and the microphone or beam in the acoustic shadow of the active signal or source, which may be in the opposite direction (or farthest away from the active talker or audio source) to be the noise source. The NC method is unique in that it makes use of multiple sources (e.g., beams or microphones) available in the communication system (e.g., a conference telephone may have eight to sixteen microphones in its array) by dynamically changing (over the length of the communication session) which one of the microphones or beams is the active source and which one is the noise source based on the presently determined position of the active talker. The NC method is also unique in that, instead of doing noise cancellation for each individual microphone (e.g., using a typical NC system with two microphones), the beamformer signal is used as the active source in some cases and the opposite microphone is used as the noise source.

FIG. 1 illustrates a functional schematic of the noise cancellation (NC) process 100 carried out by NC assemblies or systems of the electronic communication systems of the present description. In this schematic, only portions of the communication system implementing the NC process are shown. Particularly, the communication system includes a set or array of microphones 110 for capturing sound in a space (e.g., conference room, interior of an automobile, or the like) and, in response, providing input audio signals 115. The communication system includes a localizer (or localizer module) 120 that processes the output signals of the microphones 110 to determine an active talker direction 125, and such processing may be performed on a nearly continuous basis to account for a change in the active talker or their position relative to the positions of microphones 110.

Figure 2:
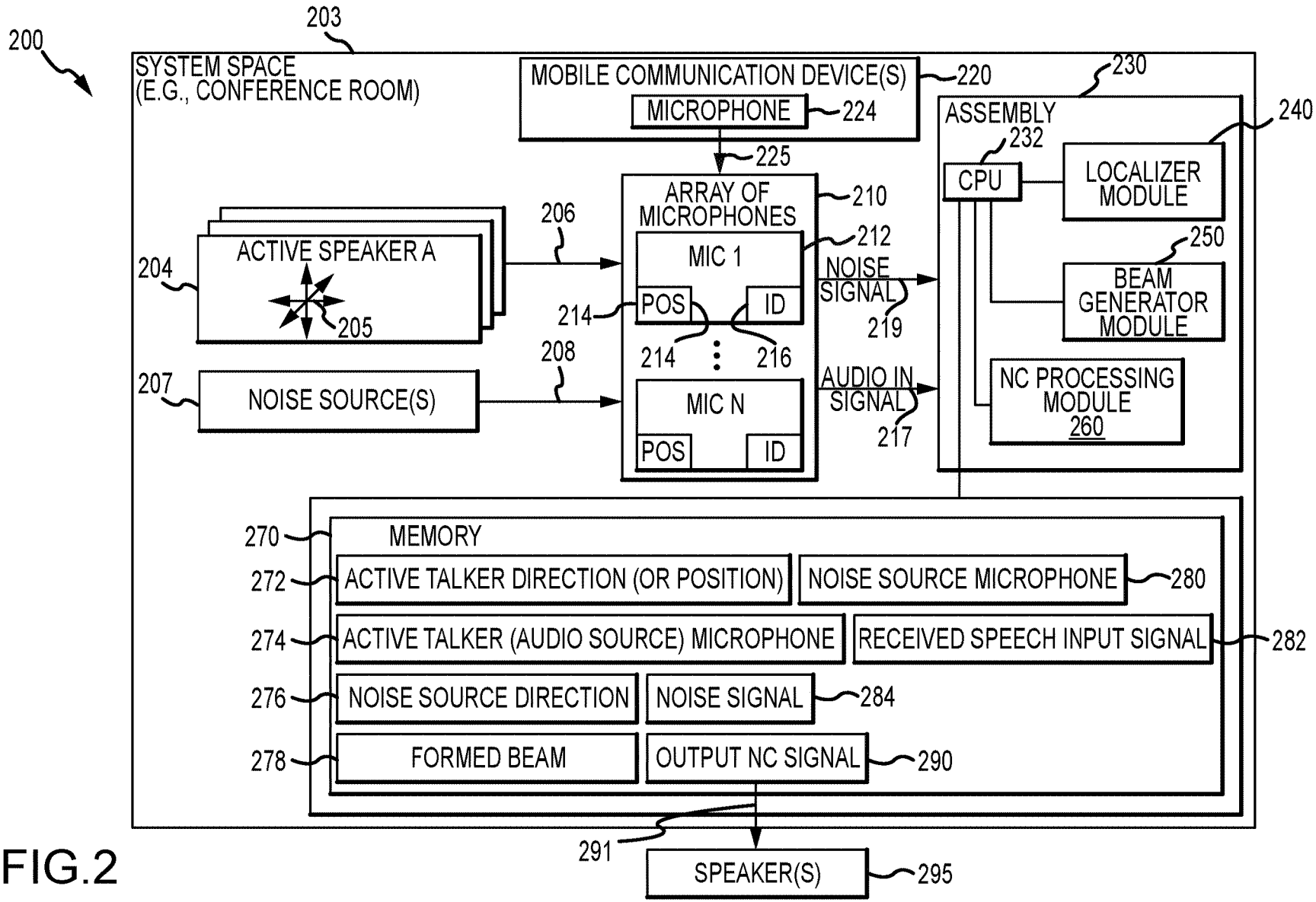
FIG. 2 illustrates a functional block diagram of a communication system adapted to perform the NC processes of the present description including the method of FIG. 1.

With the active talker direction known, the NC process 100 may continue at 130 (such as via operations of a NC processing module not shown in FIG. 1 but shown in FIG. 2) with a decision on whether to use the active talker direction provided at 125 by the localizer 120 to assign the active microphone 134 (e.g., assign the microphone in the array of microphones 110 that is "closest" in position to the active talker direction) or whether to build a beam as shown at 132 (such as with a beamformer or beam generator module as seen in FIG. 2) based on this active talker direction. The built beam or active talker microphone is provided at 136 to the NC processing module or system 150 for noise cancellation processing.

In the process 100, the active talker direction 125 is also used (such as by the NC processing module) to determine as shown at 140 a direction that is in the acoustic shadow of the active talker (which may be opposite that of the active talker direction 125). This direction/acoustic shadow determination is then provided as shown at 145 to the NC system or processing module 150 as the noise source, and the module/system 150 may use this to assign one of the microphones 110 as the noise source microphone (e.g., a microphone that is the noise source 145 that may be one that is farthest in position in the array 110 to the active microphone assigned at 134 or pointing in an opposite direction). The NC processing module/system 150 then processes signals from the active source (microphone or beam) and the noise source microphone to provide noise cancellation (with signal noise being output as shown at 160 while other processes 100 may output active talker/beam signal with such noise removed or cancelled at 160).

FIG. 2 illustrates a functional block diagram of a communication system 200 adapted to perform the NC processes of the present description including the method 100 of FIG. 1. As shown, the system 200 has its components positioned within a system space 203 that may take many forms such as a conference room, a home or other office, an interior of an automobile, and so on. In the space 203, one or more active talkers (or other audio sources) 204 may move about or otherwise not be in an optimal or "sweet spot" for NC during a communication session provided by operation of the system 200 to provide input audio or sound as shown with arrow 206 at two or more locations. Further, noise 208 may be present in the space 203 and be provided by one-to-many noise source 207 (which may be statically located or mobile during the session and may be reverberant or non-reverberant).

The communication system 200 also includes an array 210 of two or more microphones 212 for sensing or capturing the input sound/speech 206 and noise 208 and outputting an audio input signal or speech signal 217 and a noise signal 219. As discussed throughout this description, one of the microphones 212 is assigned to provide the audio in or active talker signal 217 and a different one of the microphones 212 is assigned to provide the noise signal or be the noise source, and these assignments are dynamic as they will change over time with the movement 205 of the active speaker/audio source 204. In some cases, the microphones 212 number in the range of 8 to 16 or more and are provided in the form of omnidirectional microphones positioned in different locations in the space (e.g., in a body of a conference telephone or other device(s) arranged in a circular or other pattern).

In some embodiments, the number and locations of microphones in the array (or set of available microphones) 210 is increased as shown with arrow 225 by including one or more microphones 224 of a mobile communication device 220, which may take a variety of forms of devices adapted to wirelessly communicate with the array of microphones 210 or with a transceiver (not shown) that is provided in the NC assembly 230. In one embodiment, the device 220 takes the form of a smartphone running a NC app to make itself available for inclusion in the array 210 to provide the noise signal 219 (i.e., to have its microphone 224 as the noise source microphone to provide the noise signal 219). In another embodiment, the device 220 takes the form of a portable computer (tablet or PC) running collaboration software that includes a NC function allowing itself to be included in the array 210 to provide the noise signal 219 for noise cancellation by the NC processing module 260. In yet another embodiment, wearable computers such as a smartwatch act as a remote microphone to make itself available for inclusion in the array 210 to provide the noise signal 219 (i.e., to have its microphone 224 as the noise source microphone to provide the noise signal 219 for noise cancellation by the NC processing module 260). The benefits in using any mobile device such as phones, portable computers, wearables and the like, is that it bolsters the utility of the patent overall since a talker in a communication session may move about a conference room or space. The talker or audio source often changes over time and positions of noise sources vary during the conference session.

The microphones 224 may be considered "remote" as they are spaced apart some distance from the microphones 212 and may be mobile to be positioned further from the active talker 204 and/or nearer to the noise source 207 to improve noise cancellation results achieved in system 200. The addition of the microphones 224 to the noise source-detecting microphones of array 210 extends the "localizer" capability to detect more accurately one or more noise signal sources 207 and/or increasing the resolution by more efficiently locating the noise source(s) 207 in space 203. For example, the noise source 207 may be an air conditioner that is humming or otherwise making noise 208, and this air conditioner may be 20 feet away from a conference phone unit with the microphones 212 of the array 210. Then, the mobile phone 210 that is in the acoustic shadow of the talker and/or that is closest to the air conditioner 207, in some embodiments, is better at detecting the noise characteristics at its actual source (than from afar) while also being less likely to pick up the active speaker input or speech 206 than one of the microphones 212 in the array 210. An adaptive filter, which may be provided in the NC assembly 230, may be used to compensate for any gain/attenuation due to the additional microphones 224. Other factors that the NC assembly 230 may have to compensate for include delay and signal correlation between noise 208 captured by microphone 224 (e.g., Bluetooth compression).

The system 200 includes an NC assembly or system 230 for processing the outputs 217 and 219 of the microphone array 210 to provide adaptive noise cancellation. To this end, the NC assembly 230 includes one or more processors 232 that run or execute code to provide the functionality of the localizer module 240, the beamformer or beam generator module 250, and the NC processing module 260. Further, the processor 232 manages access (e.g., by the modules 240, 250, and 260) to the memory or data storage 270 of the NC assembly 230 (on the same device or accessible by the processor 232).

During operations of the system 200 to provide noise cancellation, the localizer 240 processes outputs from the microphones 212 in array 210 to determine an active talker direction (or position in some cases) that is stored in memory 270 as shown at 272. The NC processing module 260 uses this information to determine which of the microphones 212 matches this direction or position 272 and should be used as the active talker (or audio source) microphone or beam 274 (with this assignment being stored in memory 274 including at least the identifier 216 for the microphone 216 and, in some cases, the microphone's relative position 214 within the array 210). Until a new assignment is made, the audio source 212 assigned to be the active talker source 274 is used to provide the audio in or active speaker signal 217 for use in noise cancellation by the NC processing module 260. The beam generator module 250 is used to generate a beam that may be used to obtain the audio in signal 217 in some cases, and this formed beam 278 may be stored in memory 270.

The NC processing module 260 uses the active talker direction 272 to determine which of the microphones 212 (or 224 in some cases) in the array 210 should be assigned as the noise source microphone 280 and used to provide the noise signal 219 for noise cancellation by the NC processing module 260. This may involve first using the NC processing module 260 to determine a noise source position 276 that is in the acoustic shadow of the active talker, which may be opposite in direction of the active talker direction 272 or may be opposite of a direction of the beam 278. In some cases, though, the active talker position 272 or the position 214 of the microphone 212 assigned to be the active source microphone 274 is used to determine which of the microphones 212, 224 is furthest away from the active speaker position or the microphone used as the active source. This limits the amount of speech/active talker output that is included in the noise signal 219 provide to the NC processing module 260. The received speech input signal 282 and noise signal 284 from the active talker microphone and noise source microphone, respectively, are stored in memory 270 and uses as input by the NC processing module 260 to perform noise cancellation and generate an output NC signal 290, which is provided as shown with arrow 291 to one or more speakers 295 of the communication system 200.

As discussed above, the localizer function (e.g., the operation of the localizer module 240 in FIG. 2 or the localizer 120 in FIG. 1) may be performed in a variety of ways to provide localization, e.g., to determine which direction the voice is active (and/or to provide the current position of the active speaker relative to the array of microphones). In one exemplary implementation of the NC assembly/system, the localizer implements localization using the techniques for a reverberant environment as taught in U.S. Pat. No. 7,130,797, which is incorporated herein by reference. In brief, determining the active talker direction, forming the beam, and determining a noise source direction includes: (a) analyzing the acoustical energy of the microphones of the array, (b) determining which of these microphones gives the greatest energy; (c) scanning all the microphones for energy readings to build a beam (such as with the beam generator module 250 to obtain a general area where the signal may be); (d) building beams and looking at the energy of the beams to create better resolution of the active direction; (e) determining the beam is formed based on the energy measurements from each microphone in the array (e.g., Direction 0 through Direction 8 for an array of 8 microphones or ActiveSourceDirection=Localizer (Input1, Input 2, . . . Input8); (f) beamforming to enhance the energy of that signal; (g) determining the oppositional direction from the active signal direction; and (h) designating the embedded microphones that contribute to the beam (for the audio in signal or active talker source for noise cancellation).

Hence, if all the microphones of the array lead (based on the acoustical energy) to the determination of the active signal, then the system is better able to differentiate the noise source from the active signal source. This may involve identifying the microphone in the acoustic shadow of the active direction (e.g., NoiseSource=Opposite(ActiveSource) in some non-limiting examples).

Extension or remote microphones (such as a microphone 224 of a mobile communication device 220 in FIG. 2) may be used to find (or obtain the noise signal) the noise source. These microphones may be wired or may be wirelessly in communication with the NC assembly/system (e.g., via Bluetooth or the like). However, the added microphones are focused on only detecting a noise source(s). The localizer algorithm may be configured to detect the microphone that is closest to the noise source, which is may take the existing process and enhance it with the crowd-sourcing effect of "deputizing" additional microphones (e.g., those on mobile communication devices such as each attendee of a conference's smartphone) that are deployed throughout a conference or other space in which the new system is implemented. The mobile communication units may have an installed app, such as a conference telephony app, and this app may also use microphones in slave mode not for voice signal detection but to further isolate the noise source with greater resolution. The microphone chosen for use as the noise source may not necessarily be the one closest to the noise generator because it will typically be the microphone that is in best position to detect noise (i.e., in acoustic shadow of active talker) and may be the furthest from the speech signal (e.g., ActiveSource=Data(ActiveSourceDirection and NoiseSource=Data(NoiseSource)).

Once the noise source is determined (i.e., a microphone is assigned to be the noise source or provide the noise signal), these signals can be input into an adaptive noise cancelling system (e.g., for processing by the NC processing module 260 of FIG. 2 or by system 150 in FIG. 1). The resulting or output signal from such noise cancellation may be provided obtained by obtaining the signal or audio input from the microphone in the active talker direction and subtracting the noise, which may be taken to be the signal from the microphone in the noise source direction. In some cases, the audio input or active talker signal is active beam in the active talker direction and the noise subtracted is also obtained by applying beamforming (or by using the noise source microphone).

Figure 3:
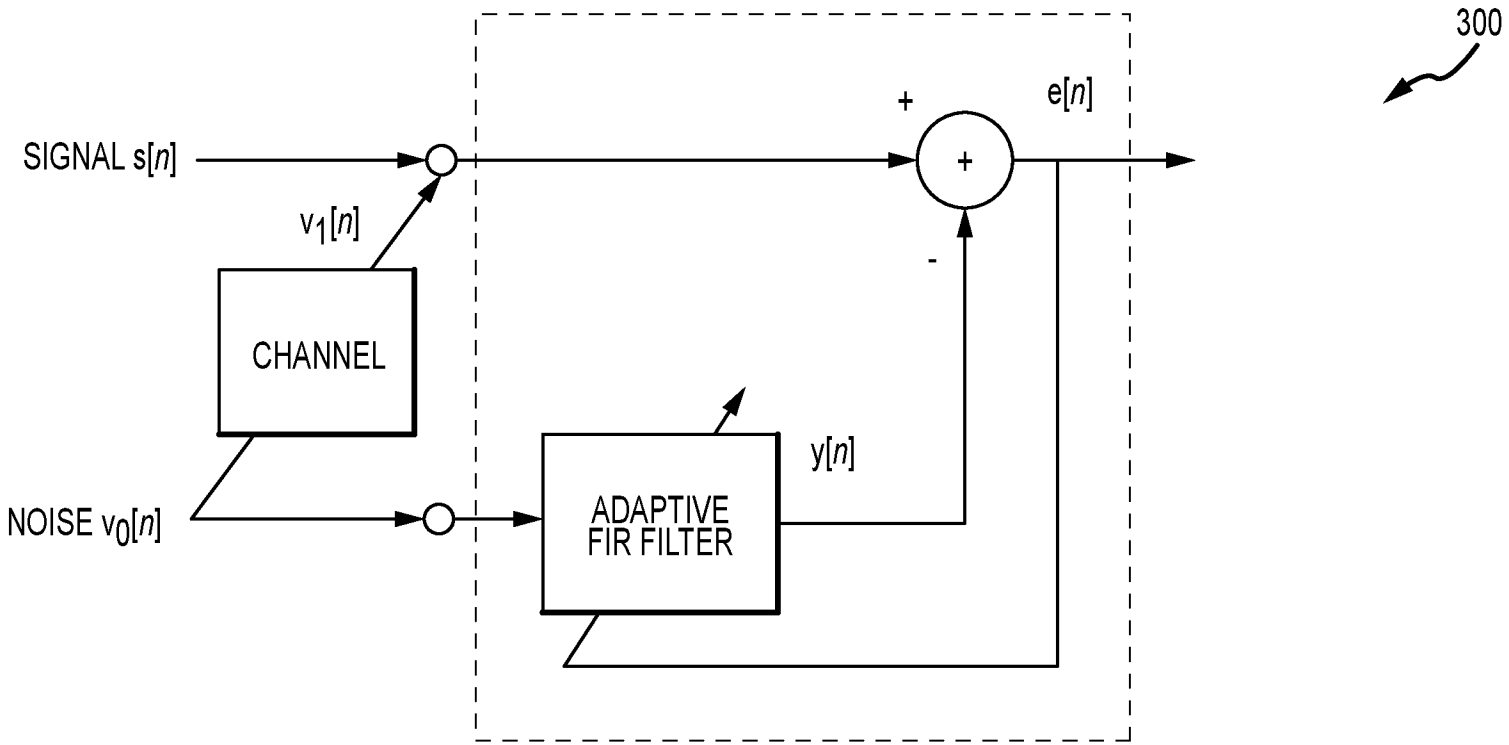
FIG. 3 illustrates an exemplary adaptive noise cancelling system or assembly for use in carrying out the NC process of FIG. 1 or within NC assembly of the communication system of FIG. 2.

In still other implementations, the noise cancellation may take the form shown by the NC system/assembly 300 shown in FIG. 3. The following pseudo code can be used to demonstrate how an adaptive process based on an NLMS (normalized least mean squares) formula calculates the noise channel. By modeling the noise that should be subtracted from the active microphone, the system 300 can more effectively cancel the noise. The pseudo code in the adaptive process is related to the adaptive noise cancelling system 300 depicted in FIG. 3 and may be stated as:

```
Signal (or ActiveSource)=Mic(ActiveDirection) or Beam
    (ActiveDirection)
Noise (or NoiseSource)=Mic(NoiseSourceDirection)
VAD_decision=VoiceActivityDetect(ActiveSource)
If (VAD_decision=Noise)
    Adapt NLMS filter using ActiveSource and Noise-
        Source Data
ElseIf (VAD_decision==Speech)
    Do Not Adapt NLMS filter
Calculate EstimatedNoise (or NoiseReplica) using NLMS
    filter (NoiseReplica=filter(NLMS_coefficients, Noise-
    Source)
Output=ActiveSource−EstimatedNoise (or NoiseReplica)
```

Figure 4:
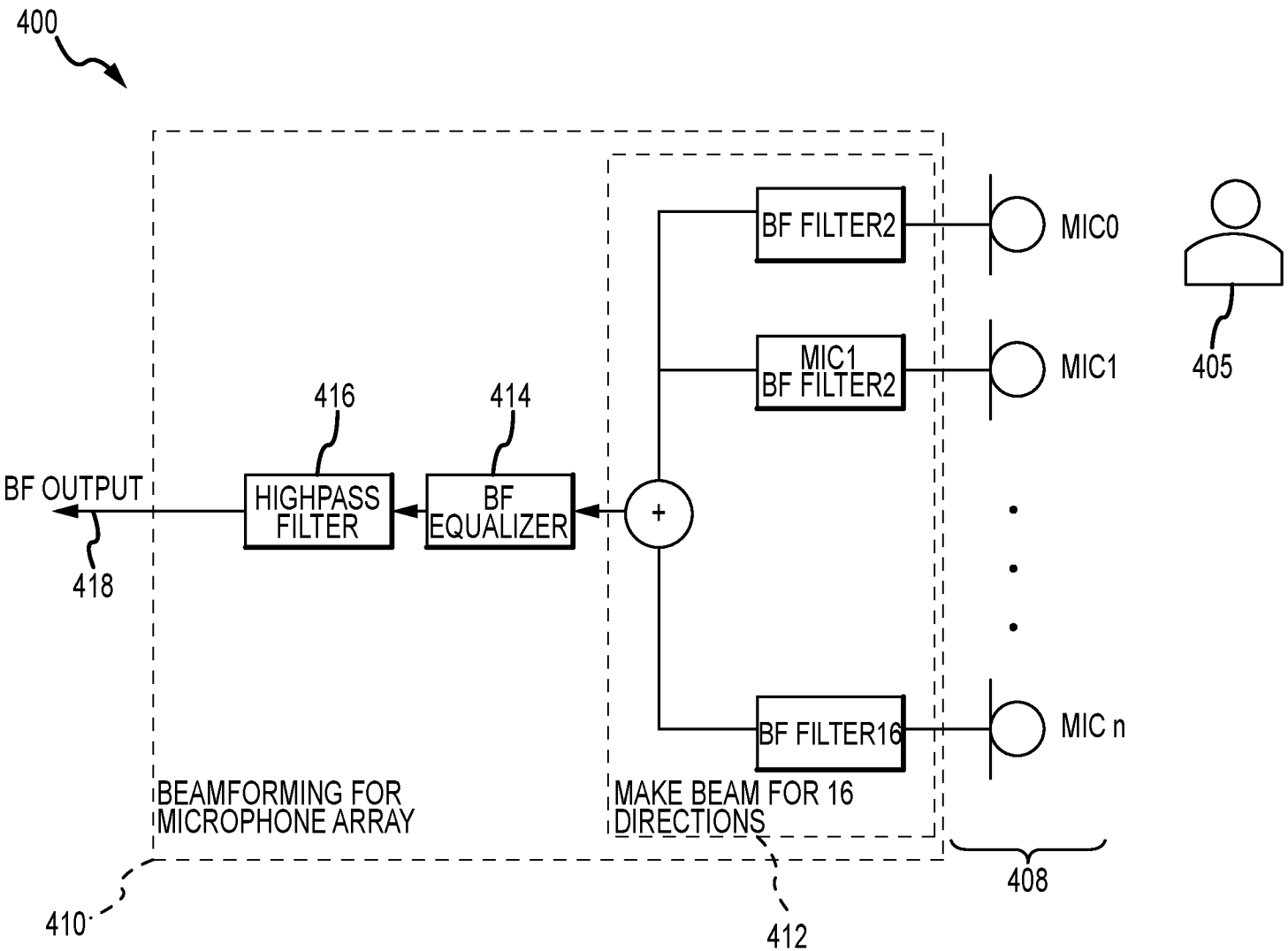
FIG. 4 illustrates beamforming as may be provided in the adaptive noise cancellation.

As discussed for step/block 132 in process 100 in FIG. 1 and for beam generator module 250 in FIG. 2, one useful function carried out by the communication system (e.g., by the NC assembly/system) to achieve adaptive noise cancellation is to create a beam in the direction that emphasizes the signal from the active talker. FIG. 4 illustrates the beamforming or beam generation process with schematic FIG. 400. As shown, a user or talker 405 may be interacting with a system (e.g., a conference telephone system or the like) with an array of microphones 408, which provide their output to the beamformer 410 to generate a beam and provide the processed microphone output at 418. Beamforming techniques are well-known in the telephony industry, and, hence, these will not be described in detail here. Further, any of a wide variety of these beamforming processes may be used in the communication systems described herein including, but not limited to those implemented in products distributed by Mitel including the Mitel 6970 IP Conference Phone.

As shown in FIG. 4 in box 412, the beamformer makes a beam in all directions associated with microphone array 408, and this additive signal is provided to a BF equalizer 414 and then a highpass filter 416 to produce the beamformer output 418 for use as input by the NC processing module/algorithm. The highpass filter 416 reduces low frequency noise. In some embodiments, the roll-off frequency at 180 Hz, and the beamformer is useful for reducing noise but may remove energy from the speech of the talker 405.

Figure 5:
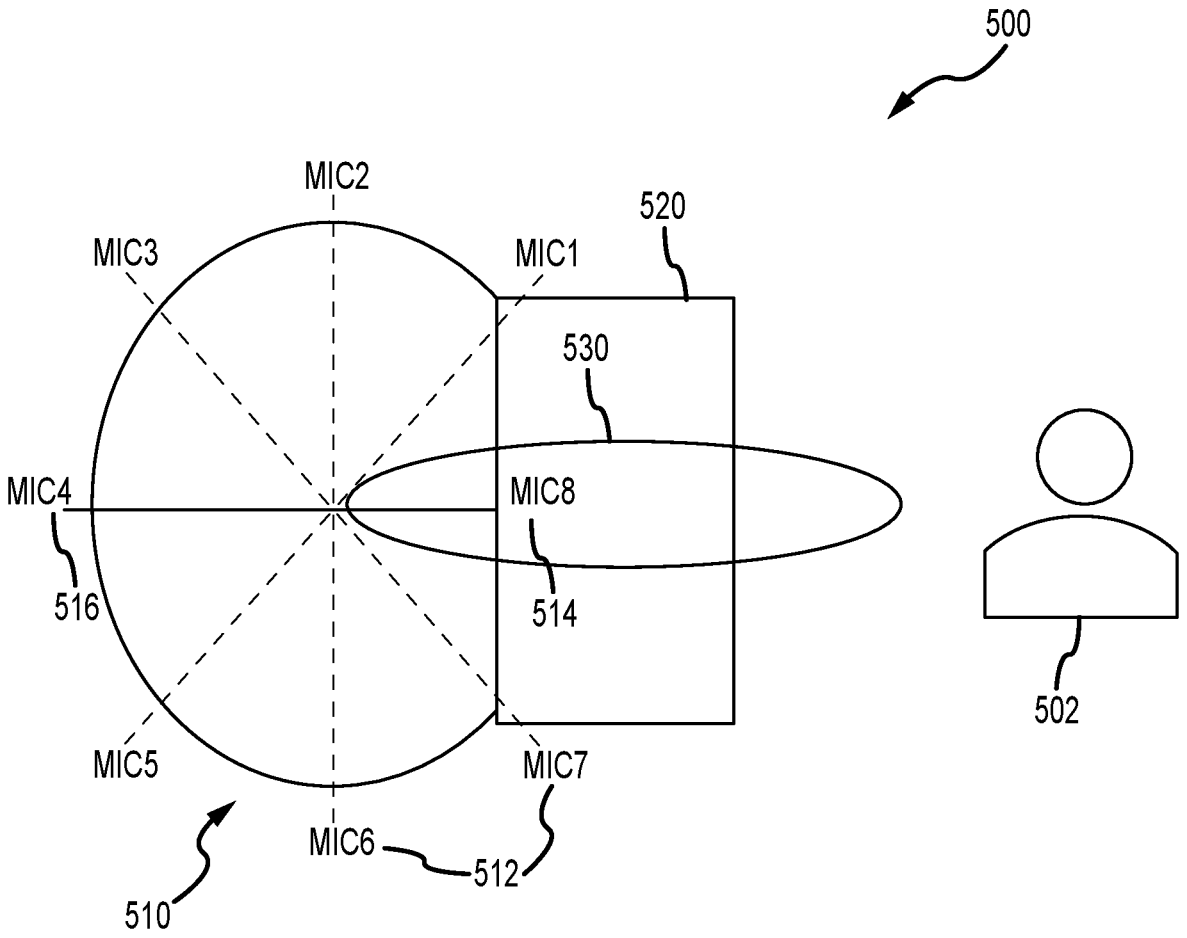
FIG. 5 illustrates a schematic of a communication system operating with adaptive noise cancellation according to the present description.

FIG. 5 illustrates a schematic of a communication system 500 operating with adaptive noise cancellation according to the present description. The system 500 may include an active talker 502 in a conference room or other space, and the talker/user 502 may operate a conference phone or similar unit 510 that includes a plurality of microphones 512 (with 8 microphones that equally spaced in a circular pattern being shown as a non-limiting example) and a keyboard 520.

The system 500 includes software (and/or hardware) to perform the adaptive noise cancelling described herein including determining a direction of the active talker 502 as shown with ellipse 530 and, in response, selecting an active talker or audio source microphone 514 based on that determined direction 530. Further, a microphone 516 is selected in the acoustic shadow of the active talker 502 (which could be in the opposite direction as the active talker microphone 514 in some cases) for use as the noise source for noise cancelling. The system 500 functions to create a beam in the direction 530 of the active talker 502 that emphasizes the signal from the active talker 502. Noise cancellation is typically performed after the beamformer output is provided. Only one adaptive noise cancellation system is needed rather than on each microphone 512, and, for many currently in production communication systems, there is minimal effect on the other parts of the system.

Figure 6A:
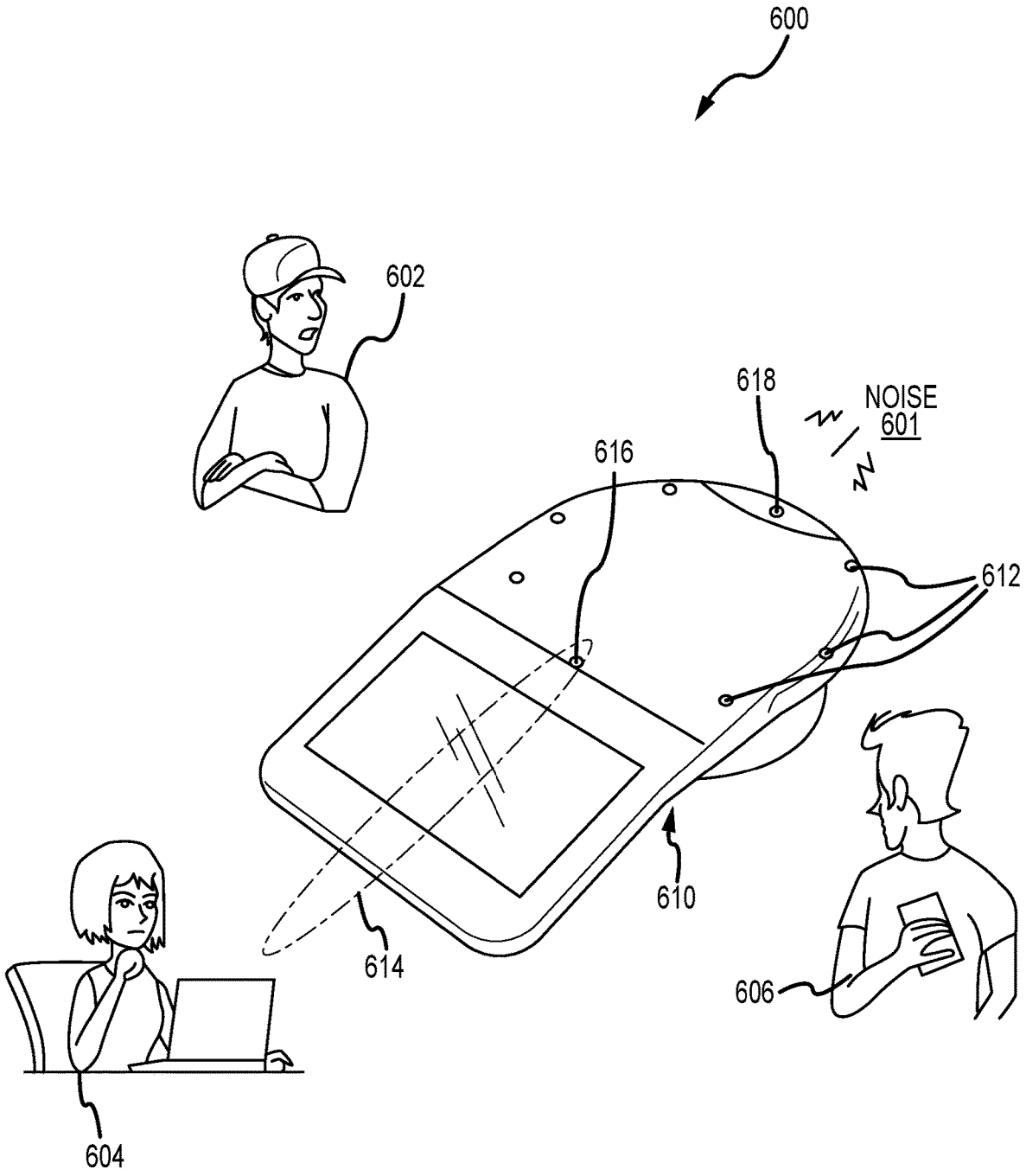
FIGS. 6A and 6B illustrate a communication system operating to provide the adaptive noise cancellation of the present description at first and second times during a communication session.
Figure 6B:
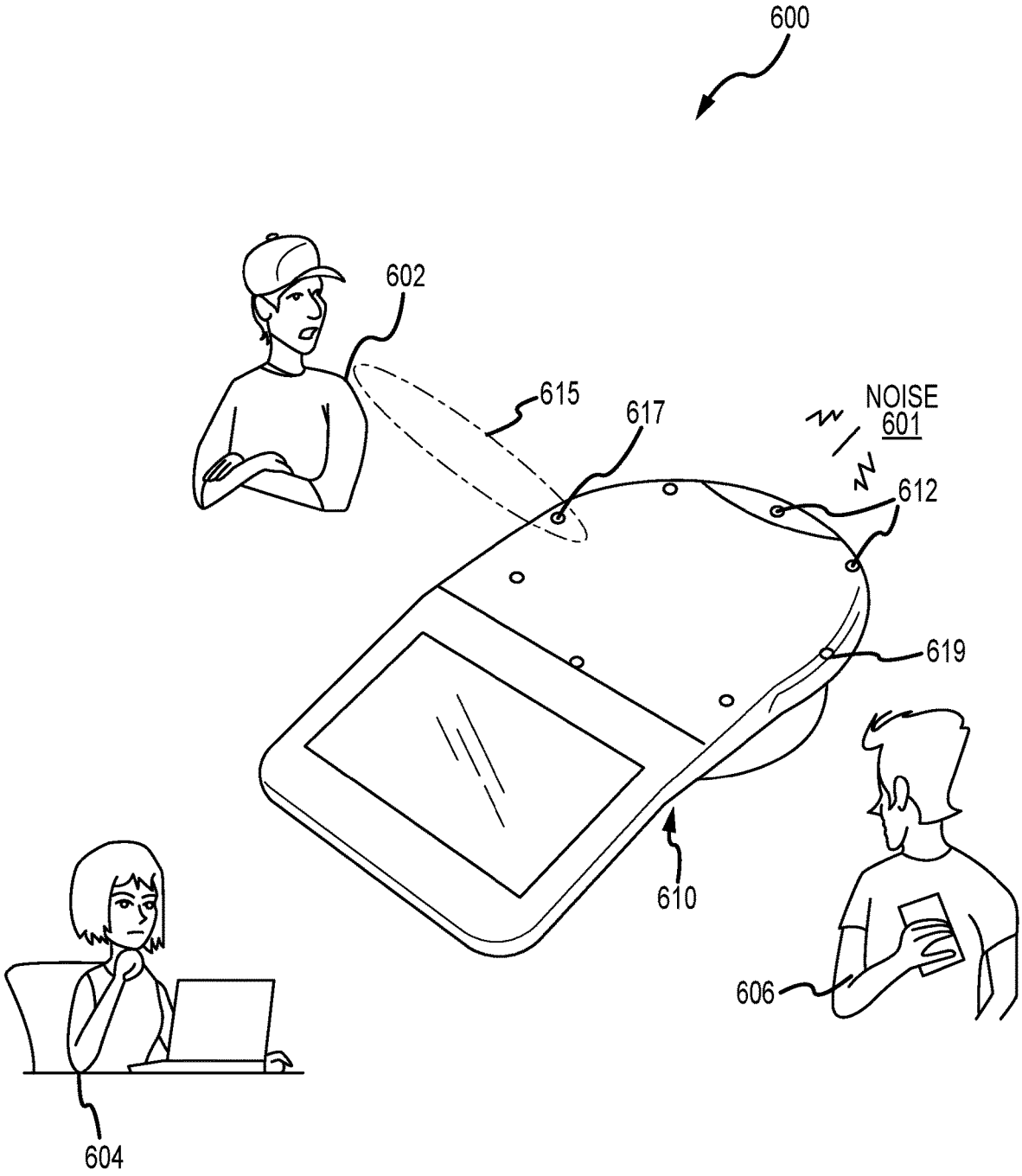

FIGS. 6A and 6B illustrate a communication system 600 operating to provide the adaptive noise cancellation of the present description at first and second times during a communication session. The system 600 includes a conference telephone unit 610 with an array of eight spaced-apart microphones 612, and the unit 610 is positioned in a space (e.g., a conference room, an office, or the like) with three attendees 602, 604, and 606 who may become active talkers during the communication session and who are located in different positions and/or directions from the unit 610 and the array of microphones 612. Also, noise 601 is present in the space and may include continuous sources, intermittent sources, and/or moving sources.

In a first operating state associated with a first time in the communication session as shown in FIG. 6A, the unit 610 has operated to determine a direction to the current active talker 604 and has formed a beam 614 to enhance the energy of her speech for use in noise cancellation. Further, a first microphone 616 has been chosen from the array of microphones 612 that is closest in position and/or is in the same determined direction. A second microphone 618 is selected that is in the opposite direction and/or is the furthest in the array of microphones 612 from the active talker microphone 616, and the microphone 618 is used in noise cancellation as the noise source, so as to collect a signal corresponding with noise 601 that includes a relatively small amount of speech from active talker 604.

In a second operating state associated with a second time in the communication session as shown in FIG. 6B, the unit 610 has operated to determine a direction to the current active talker 602 (which differs from that found for talker 604) and has formed a beam 615 to enhance the energy of his speech for use in noise cancellation. Further, a third microphone 617 (different from that used for talker 604) has been chosen from the array of microphones 612 that is closest in position and/or is in the same determined direction. A fourth microphone 619 is selected that is in the opposite direction and/or is the furthest in the array of microphones 612 from the active talker microphone 617, and the microphone 619 (which differs from the previously used microphone 618) is used in noise cancellation as the noise source, so as to collect a signal corresponding with noise 601 that includes a relatively small amount of speech from active talker 602.

Note, the noise signal will differ between the two operating states even without changes in noise 601 itself, but both noise source microphones 618 and 619 are selected as being in the acoustic shadow based on the determined position and/or direction of the active talkers. The systems described herein, including system 600, takes advantage of the fact that the signal source (active talker) tends to be more directional, and the system is adapted to find that direction whereas the noise/environment source is often not as directional.

As used herein, the terms application, module, analyzer, engine, and the like can refer to computer program instructions, encoded on computer storage medium for execution by, or to control the operation of, data processing apparatus. Alternatively or additionally, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of the substrates and devices. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., solid-state memory that forms part of a device, disks, or other storage devices).

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. The features of the various embodiments may stand alone or be combined in any combination. Further, unless otherwise noted, various illustrated steps of a method can be performed sequentially or at the same time, and not necessarily be performed in the order illustrated. It will be recognized that changes and modifications may be made to the exemplary embodiments without departing from the scope of the present invention. These and other changes or modifications are intended to be included within the scope of the present invention, as expressed in the following claims.

For example, an electronic communication system as called out in the following claims may include a wide variety of telephone systems (or telephony software hardware units as used, for example, for conference calls), but the NC concepts and processes may be readily be used in nearly any electronic communication system that has two or more microphones (audio sources) as the NC ideas taught herein do not have to be used only with a phone HW (CU with multiple mics) only. It can also be applied for or in: (a) a car NC speakerphone (e.g., if there is one microphone pointing at the driver (speech mic) and another microphone (noise mic) in the back of the car to pick up noise and, if there is a passenger sitting in the back, and they start talking the previously statically allocated "noise mic" can now become the "speech mic:" with the new NC algorithm; (b) PC/laptop with multiple microphones can also use the NC algorithm (as an application on a PC, for example). In this second example, "microphone" may be one or more of: a camera mic; an embedded mic; analog/USB/BT headphones, when attached simultaneously they could all be in 'listening mode' and used to find active source direction (mic that is used for the active audio connection); and the best noise source (e.g., another mic that is connected, not set-up for the audio connection of a conference call, but actively picking up the noise, while best shielded from voice). In this case, the system would know which mic is active (mic would be selected as audio mic used for that call), and, using the localizer algorithm, the system would find the mic that is picking up the least amount of voice and use it as the noise source. These further examples of electronic communication systems make it clear that nearly any system with two or more microphones may implement the NC techniques taugher herein as, for example, a SW module used on any PC HW with multiple mics in passive 'listening' mode.

Also, it should be understood that a wide variety of microphones may be used as the noise source microphone, and these microphones may by part of an array (e.g., in a conference phone unit) or may be nearly any microphone in a device that is remote from such a communication unit used to capture the talker's speech. The noise source microphone may be provided as one of the microphones in a separate, remote PC/laptop, may be a camera microphone, may be an embedded microphone, may be microphone in a headset (e.g., analog/USB/BT headphones), and/or microphone in another portable or stationary device in a space for which NC is desired (such as a microphone in a vehicle's interior).

We claim:

1. An electronic communication system with adaptive noise cancellation, comprising:

an array of microphones at a plurality of positions in a space for receiving a speech signal from one or more audio sources in the space and a noise signal from the space; and a noise cancellation (NC) assembly comprising a processor executing code or instructions to provide functions of a localizer module and an NC processing module;

wherein the localizer module processes the speech signal from the one or more audio sources to determine a direction of an active talker, wherein the NC processing module uses a first one of the microphones based on the direction of the active talker as an active talker source and a second one of the microphones, differing from the first one, based on the direction of the active talker as a noise source, and wherein the NC processing module processes the output of the first and second microphones to generate an audio signal with noise cancellation, wherein the first one of the microphones is selected to be in a direction matching the direction of the active talker or to be closest in relative position in the array of the microphones to a position of the active talker and wherein the second one of the microphones is selected is selected to be in an acoustical shadow of the first one of the active talker.

2. The electronic communication system of claim 1, wherein a position of the active talker relative to the array of microphones varies during a communication session.

3. The electronic communication system of claim 2, wherein, during the communication session, the localizer module second processes the speech signal from the one or more audio sources to determine a second direction for the active talker or a second active talker and wherein, in response, the NC processing module uses a third one of the microphones based on the second direction as the active talker source and a fourth one of the microphones, differing from the third one, based on the second direction.

4. The electronic communication system of claim 1, wherein the second one of the microphones is selected to be in a direction opposite the direction of the active talker or to be farthest from the first one of the microphones in the array of the microphones.

5. The electronic communication system of claim 1, wherein the array of microphones includes at least one microphone in a mobile communication device communicatively linked to the NC processing module and wherein a position of the at least one microphone in the mobile communication device is communicated to the NC processing module.

6. The electronic communication system of claim 5, wherein the NC processing module uses the at least one microphone in the mobile communication device as the noise source when the position of the at least one microphone in the mobile communication device indicates the at least one microphone in the mobile communication device is furthest away from a position of the first one of the microphones being used as the active talker source.

7. The electronic communication system of claim 1, wherein the NC assembly further comprises a beam generator module operating to build a beam using the direction of the active talker and wherein the NC processing module uses output of the beam generator module along with the output of the noise source to provide the audio signal with noise cancellation.

8. The electronic communication system of claim 7, wherein the second one of the microphones is selected to have a direction or position in the array that is opposite a direction of the beam.

9. A method of providing adaptive noise cancellation in a communication system, comprising:

operating a plurality of microphones to provide input audio signals;

with a localizer, processing the input audio signals to determine a direction to an active talker relative to the plurality of microphones;

selecting one of the plurality of microphones to be a noise source, wherein the selected one of the plurality of microphones has a direction that is opposite the direction to the active talker or has a position that is furthest among the plurality of microphone away from the active talker;

performing noise cancellation on the input audio signals using output of the noise source; and selecting one of the plurality of microphones to be an active talker source that matches the direction to the active talker or that has a position that is closest among the plurality of microphone to the active talker, wherein the performing the noise cancellation includes using a signal from the active source along with the output of the noise source.

10. The method of claim 9, further comprising, with a beamformer, forming a beam by processing the input audio signals from the plurality of microphones, wherein the performing the noise cancellation includes using an output signal from the beamformer along with the output of the noise source.

11. The method of claim 9, wherein the plurality of microphones includes a microphone of a mobile communication device and wherein the selecting of one of the plurality of microphones to be the noise source includes choosing the microphone of the mobile communication device when it is determined to have a position that is furthest among the plurality of microphone away from the active talker.

12. The method of claim 9, further comprising repeating the processing, selecting, and performing steps to identify a second direction to the active talker, to select a second one of the plurality of microphones for use as a second noise source based on the second direction to the active talker, and to perform the noise cancellation using an output of the second noise source.

13. An electronic communication system with adaptive noise cancellation, comprising:

an array of microphones;

a localizer module configured to: (a) first, process output signals from the microphones to determine a first direction of an audio source, and fb second, process output signals from the microphones to determine a second direction of the audio source, and an noise cancellation (NC) processing module configured to: (a) first, select (i) a first one of the microphones based on the first direction of the audio source as a first active source, and (ii) a second one of the microphones as a first noise source that picks up a least amount of energy from the first active source, and (b) second, select (i) a third one of the microphones based on the second direction of the audio source as a second active source, and (ii) a fourth one of the microphones as a second noise source that picks up a least amount of energy from the second active source, wherein the NC processing module first processes signals of the first active source and the first noise source to generate a first audio signal with noise cancellation and second processes signals of the second active source and the second noise source to generate a second audio signal with noise cancellation, and wherein the second one of the microphones is selected to be in an acoustical shadow of the first one of the microphones and the fourth one of the microphones is selected to be in an acoustical shadow of the third one of the microphones.

14. The electronic communication system of claim 13, wherein the array of microphones includes at least one microphone in a mobile communication device communicatively linked to the NC processing module and wherein a position of the at least one microphone in the mobile communication device is communicated to the NC processing module.

15. The electronic communication system of claim 14, wherein the NC processing module uses the at least one microphone in the mobile communication device as the first or second noise source when the position of the at least one microphone in the mobile communication device indicates the at least one microphone in the mobile communication device is furthest away from a position of the first or third one of the microphones being used as the first or second active source, respectively.

16. The electronic communication system of claim 13, further comprising a beamformer building a beam using outputs of the microphones and wherein the NC processing module uses first and second output signals of the beam generator module along with the signals of the first and second noise source, respectively, to provide the first and second audio signals with noise cancellation.

17. The electronic communication system of claim 16, wherein the second one of the microphones is selected to have a direction or position in the array that is opposite a direction of the beam.

* * * * *